US007384583B2

(12) United States Patent
Hisada et al.

(10) Patent No.: US 7,384,583 B2
(45) Date of Patent: Jun. 10, 2008

(54) PRODUCTION METHOD FOR MAKING NONWOVEN FABRIC

(75) Inventors: Minoru Hisada, Sodegaura (JP); Kenichi Suzuki, Sodegaura (JP)

(73) Assignee: Mitsui Chemicals, Inc., Tokyo (JP)

( * ) Notice: Subject to any disclaimer, the term of this patent is extended or adjusted under 35 U.S.C. 154(b) by 490 days.

(21) Appl. No.: 10/297,761

(22) PCT Filed: Apr. 4, 2002

(86) PCT No.: PCT/JP02/03383

§ 371 (c)(1),
(2), (4) Date: Dec. 9, 2002

(87) PCT Pub. No.: WO02/084007

PCT Pub. Date: Oct. 24, 2002

(65) Prior Publication Data

US 2003/0178741 A1 Sep. 25, 2003

(30) Foreign Application Priority Data

Apr. 6, 2001 (JP) ..... 2001-109088

(51) Int. Cl.
*B29C 47/60* (2006.01)

(52) U.S. Cl. ..... 264/211.17; 264/211.22

(58) Field of Classification Search ..... 264/165, 264/176.1, 211.22, 211.23, 211.12, 211.13, 264/211.14, 211.17; 425/72.1, 72.2, 66, 425/378.1, 378.2

See application file for complete search history.

(56) References Cited

U.S. PATENT DOCUMENTS 2,273,105 A * 2/1942 Heckert ..... 264/211.15
3,070,839 A * 1/1963 Thompson ..... 425/72.2
3,834,847 A * 9/1974 Fletcher ..... 425/72.2
3,999,910 A * 12/1976 Pendlebury et al. ..... 425/72.2
4,492,557 A * 1/1985 Ray et al. ..... 425/72.2

(Continued)

FOREIGN PATENT DOCUMENTS

JP 7-11559 A 1/1995

(Continued)

*Primary Examiner*—Carlos Lopez
(74) *Attorney, Agent, or Firm*—Birch, Stewart, Kolasch & Birch, LLP

(57) ABSTRACT

The invention provides a method for manufacturing spun-bonded nonwoven fabrics that can reduce the diameter of a filament without decreasing productivity and can stably produce nonwoven fabrics, which comprises quenching a multiple number of continuous melt-spun filaments through spinning nozzles with quench air fed to a quenching chamber, drawing the filaments with drawing air, and depositing the filaments on a moving collector surface, characterized in that the quench air fed to the quenching chamber is divided into at least 2 streams in vertical direction, wherein an air velocity of the quench air in the lowermost stream is set higher than that of the quench air in the uppermost stream. The invention also provides an apparatus for manufacturing spun-bonded nonwoven fabrics comprising spinning nozzles for melt-spinning a multiple number of continuous filaments, a quenching chamber for quenching the spun filaments with quench air, a drawing section for drawing the quenched filaments and a moving collector surface for depositing thereon the filaments drawn from the drawing section, characterized in that the quench air fed to the quenching chamber is divided into at least 2 streams in vertical direction, wherein the velocities of the quench air are independently controllable in the respective streams.

15 Claims, 1 Drawing Sheet

U.S. PATENT DOCUMENTS 4,529,368 A * 7/1985 Makansi ..... 425/72.2
4,712,988 A * 12/1987 Broaddus et al. ..... 425/72.2
4,820,142 A * 4/1989 Balk ..... 348/97
4,851,179 A 7/1989 Reifenhauser
4,943,220 A * 7/1990 Fourne ..... 425/66
5,028,375 A * 7/1991 Reifenhauser ..... 264/518
5,173,310 A * 12/1992 Katou et al. ..... 425/72.2
5,928,587 A * 7/1999 Schippers ..... 264/103
6,432,340 B1 * 8/2002 Vassilatos ..... 264/176.1
6,538,432 B1 * 3/2003 Bacon et al. ..... 324/223
6,551,545 B1 * 4/2003 Hutter et al. ..... 264/555

FOREIGN PATENT DOCUMENTS

JP 2000-64115 A 5/2000
WO WO 98/29583 * 7/1998
WO WO 00/65133 A2 11/2000

* cited by examiner

PRODUCTION METHOD FOR MAKING NONWOVEN FABRIC

This application is the national phase under 35 U.S.C. §371 of PCT International Application No. PCT/JP02/03383 which has an International filing date of Apr. 4, 2002, which designated the United States of America.

TECHNICAL FIELD

The present invention relates to a method for manufacturing nonwoven fabric, especially a spun-bonded nonwoven fabric which are suitable for a variety of uses including medical, sanitary, civil engineering, industrial and packaging materials. The invention also relates to an apparatus for the method described above.

TECHNICAL BACKGROUND

As manufacturing method for spun-bonded nonwoven fabric, there are known the opened type method, which comprises quenching melt-spun filaments with quench air, drawing the filaments by passing them through round air guns or slit air guns and then spreading them onto a mesh belt using a separator or an oscillator, and the closed type method, which comprises quenching the melt-spun filaments with quench air fed to a quenching chamber, drawing the filaments through nozzles by reusing the quench air as drawing air and spreading the filaments onto a mesh belt, as described in, e.g., Japanese Patent Laid-Open No. 57-35053 or 60-155765.

In the method for manufacturing spun-bonded nonwoven fabric, filaments are quenched by blowing quench air against a multiple number of continuous filaments melt-spun through spinning nozzles. When an amount of the filaments to be discharged is increased with an attempt to achieve better productivity, it becomes necessary to supply a sufficient volume of quench air correspondingly to the increased amount. Where the quench air is poorly supplied, quenching of filaments is insufficient to cause the mass (shot) of resin on a web; in the opened type method, plugging occurs in a drawing device such as air guns, etc. On the other hand, when the quench air is supplied excessively, breakage of filaments would take place due to supercooling.

In applying the closed type method, good filaments are obtained in a simple process and webs with an excellent uniformity can be produced. However the filaments are drawn by the quench air fed to a quenching chamber, that is, quench air and drawing air are commonly used, so that quenching and drawing can not proceed independently. For this reason, where it is attempted to increase a drawing tension by supplying a larger amount of drawing air thereby to reduce a filament diameter, a larger amount of quench air is supplied at the same time, which would result in the breakage of filaments.

An object of the present invention is to provide a method for manufacturing spun-bonded nonwoven fabrics, which causes no breakage of filaments even by supplying a large amount of quench air, can reduce the diameter of a filament without losing productivity and can produce nonwoven fabrics stably. Another object of the invention is to provide an apparatus suitable for the method above.

DISCLOSURE OF THE INVENTION

The manufacturing method for nonwoven fabric according to the present invention is a method for manufacturing spun-bonded nonwoven fabrics, which comprises quenching a multiple number of continuous filaments melt-spun through spinning nozzles with quench air fed to a quenching chamber, drawing the filaments with drawing air and depositing the filaments on a moving collector surface, characterized in that the quench air fed to the quenching chamber is divided into at least 2 streams in vertical direction, wherein an air velocity of the quench air in the lowermost stream is set higher than that of the quench air in the uppermost stream.

In the present invention, the quench air fed to the quenching chamber is vertically divided preferably into approximately 2 to 20 streams. When the quench air is divided into 2 streams, an air velocity ratio ($V_1/V_2$) of the quench air in the upper stream ($V_1$) to that in the lower stream ($V_2$) is preferably $0<V_1/V_2<0.7$.

Where the quench air fed to the quenching chamber is divided into n streams ($n \geqq 3$) in vertical direction, an air velocity ratio ($V_1/V_n$) of the quench air in the uppermost stream ($V_1$) to that in the lowermost stream ($V_n$) is preferably $0<V_1/V_n<0.7$, and the air velocity $V_m$ of the quench air in the $m^{th}$ stream (wherein $n \geqq m \geqq 2$) from the top preferably satisfies $V_m \geqq V_{m-1}$.

In the present invention, it is preferred for practical purposes that the temperatures of the quench air ranges from 10° C. to 70° C. in each of the divided streams, and the temperatures in these streams may be all the same or different at least in part. It is particularly preferred that the temperature in the uppermost stream is in the range of 10° C. to 40° C., and the temperature in the lowermost stream is higher by at least 10° C. than that in the uppermost stream and is set in the range of 30° C. to 70° C. Such a difference in temperature enables to prevent occurrence of filament breakage remarkably.

According to the present invention, there is provided an apparatus for manufacturing spun-bonded nonwoven fabrics comprising spinning nozzles for melt-spinning a multiple number of continuous filaments, a quenching chamber for cooling the spun filaments with quench air, a drawing section for drawing the quenched filaments and a moving collector surface for depositing thereon the filaments drawn from the drawing section, characterized in that the quench air fed to the quenching chamber is divided into at least 2 streams in vertical direction, wherein the velocities of the quench air are independently controllable in the respective streams.

In the apparatus for manufacturing nonwoven fabrics described above, it is preferred that a ratio in blowing area of the quench air fed to the quenching chamber ranges from 0.1 to 0.9 in the ratio of the blowing area in the uppermost stream to the total blowing area.

Figure 1:
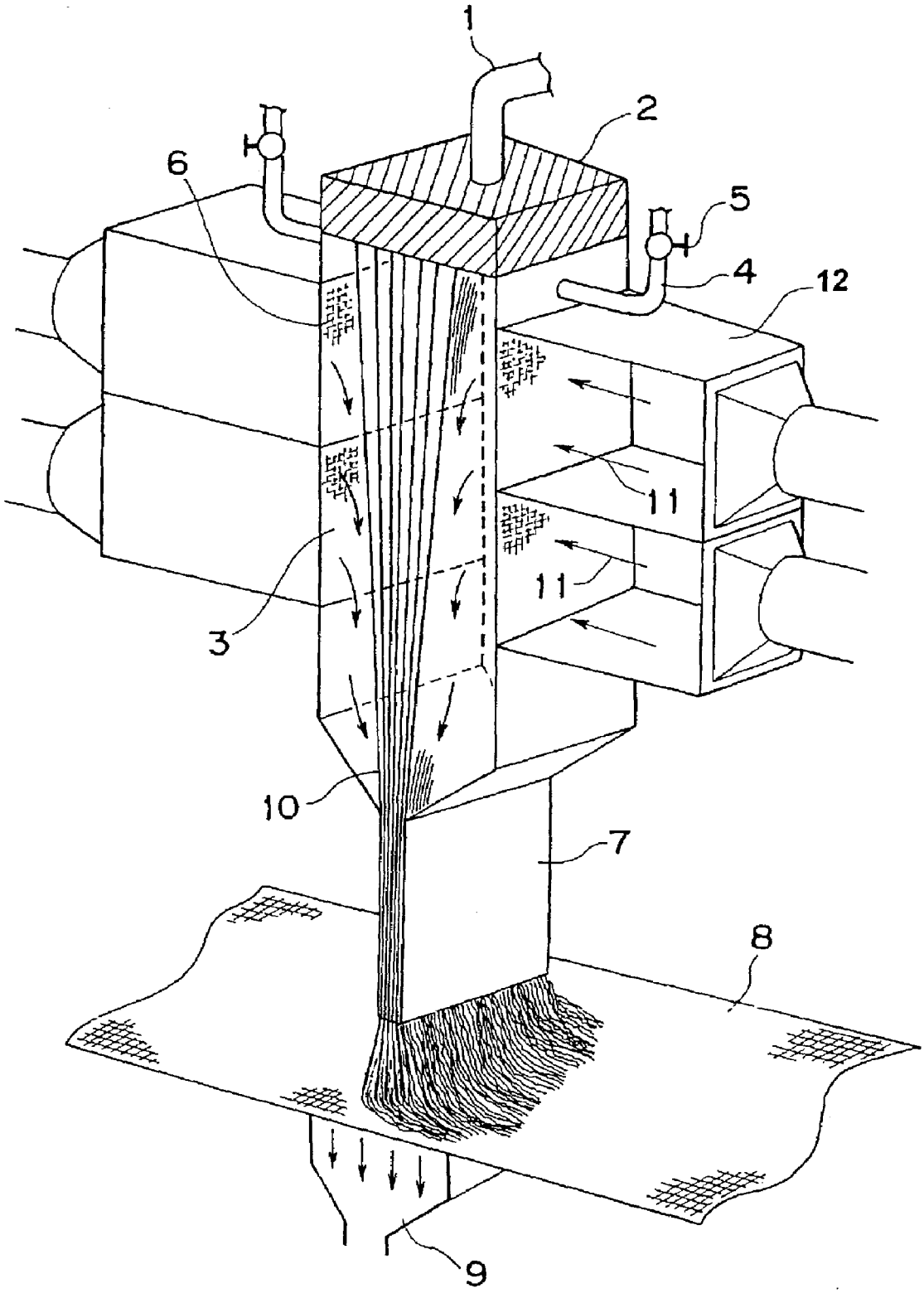
FIG. 1 is an outlined perspective view showing the partial cross-section of an apparatus for carrying out the method of the invention, wherein numerals designate the following.

1: molten resin inlet pipe
2: spinneret
3: quenching chamber
4: exhaust nozzle
5: control valve
6: mesh
7: drawing section
8: moving collector surface 9: suction box
10: filament
11: quench air flow direction
12: quench air feed chamber

BEST MODE FOR CARRYING OUT THE INVENTION

Manufacturing method for nonwoven fabric of the present invention comprises introducing a multiple number of continuous filaments discharged through spinning nozzles of a spinneret into a quenching chamber, introducing quench air from one direction or two opposite directions to quench the filaments, and in the closed type method, the quench air is narrowed down through the nozzles and used as drawing air to draw the filaments; in the opened type method, the filaments are drawn by passing them through round air guns or slit air guns for a separate supply of drawing air, and then depositing the filaments onto a moving collector surface, characterized in that the quench air fed to the quenching chamber is divided into at least 2 streams in vertical direction, wherein an air velocity of the quench air in the lowermost stream is set higher than that of the quench air in the uppermost stream. In the present invention, the term upwards is used to mean a direction approaching the spinning nozzles and the term downwards is used to mean a direction away from the spinning nozzles.

Where the quench air fed to the quenching chamber is divided into 2 streams in vertical direction, $V_1$ and $V_2$ satisfy $V_1<V_2$ when the velocities of the quench air in the upper and lower streams are $V_1$ and $V_2$, respectively. Herein, the air velocity is used to mean a flow amount of the quench air per unit cross-sectional area of the quench air feed chamber exit (inlet of the quenching chamber).

In this case it is advantageous that the air velocity ratio ($V_1/V_2$) of the quench air velocity in the upper stream ($V_1$) to that in the lower stream ($V_2$) satisfies preferably $0<V_1/V_2<0.7$, more preferably $0.01\leqq V_1/V_2\leqq 0.5$, and most preferably $0.05\leqq V_1/V_2\leqq 0.4$.

The quench air fed to the quenching chamber can also be divided into 3 streams or more in vertical direction, preferably into 3 to 20 streams. When the quench air is divided into n streams ($n\geqq 3$), it is advantageous that the air velocity ratio ($V_1/V_n$) of the quench air velocity in the uppermost stream ($V_1$) to that in the lowermost stream ($V_n$) satisfies preferably $0<V_1/V_n<0.7$, more preferably $0.01\leqq V_1/V_n\leqq 0.5$, most preferably $0.05\leqq V_1/V_n\leqq 0.4$, and the air velocity $V_m$ of the quench air in the $m^{th}$ stream (wherein $n\geqq m\geqq 2$) from the top preferably satisfies $V_m\geqq V_{m-1}$.

The blowing area of the quench air in each stream, namely, the ratio of the cross-sectional area of the divided quench air at the exit of the quench air feed chamber (inlet of the quenching chamber) is appropriately determined depending on desired cooling conditions (quenching rate). Where the velocity of the quench air is the slowest in the uppermost stream, the ratio in the blowing area (cross-sectional area) of the uppermost stream to the total area is within the range of 0.1 to 0.9, preferably 0.2 to 0.8. When the cross-sectional area is set within the range above, nonwoven fabrics of a desired quality can be produced without decreasing productivity.

For practical purposes, the temperature of the quench air divided as above is preferably set within the range of 10° C. to 70° C. in each stream. In the respective streams, the temperature may be the same or different at least in part. When the quenching chamber is divided into 2 sections, it is preferred that the temperature of the quench air in the upper section is in the range of 10 to 40° C., and the temperature of the quench air in the lower section is higher by at least 10° C. than that of the quench air in the upper section and ranges from 30° C. to 70° C. When the quenching chamber is divided into 3 sections or more, it is desired that the temperature of the quench air in the uppermost section is set between 10° C. and 40° C., and the temperature in the lowermost section is higher by at least 10° C. than that in the uppermost section and is in the range of 30° C. to 70° C.

The materials usable for manufacturing nonwoven fabrics are not particularly limited but may be any of polyester, polyamide and polyolefin resins, etc., so long as they are thermoplastic polymers. Among them, polyolefin resins are preferably employed in view of their excellent productivity.

The apparatus for manufacturing the nonwoven fabrics according to the present invention is an apparatus for manufacturing spun-bonded nonwoven fabrics comprising:

spinning nozzles for melt-spinning a multiple number of continuous filaments;

a quenching chamber for cooling the spun filaments with quench air from one direction or two opposite directions to quench the filaments; and, in the closed type method, a drawing section for narrowing down the quench air through the nozzles and using a narrowed stream of the quench air as drawing air to draw the filaments;

in the opened type method, round air guns or slit air guns for drawing the filaments with drawing air separately supplied, and a moving collector surface for depositing thereon the filaments drawn from the drawing section, characterized in that the quench air fed to the quenching chamber is divided into at least 2 streams in vertical direction and the air velocity of the quench air is independently controllable in the respective streams. By doing so, the air velocity can freely be chosen for each stream, e.g., an air velocity of the quench air in the lowermost stream may be set higher than that of the quench air in the uppermost stream.

Hereinafter the present invention is described in more detail with reference to the drawing.

FIG. 1 is an outlined perspective view showing the partial cross-section of an example of an apparatus (closed type apparatus) for carrying out the method of the invention. The apparatus basically comprises a spinneret 2 with many spinning nozzles, a quenching chamber 3 to quench filaments, a quench air feed chamber 12 for supplying the quench air, a drawing section 7 to draw the quenched filaments, and a moving collector surface 8 to deposit the filaments drawn from the drawing section 7.

The molten resin is introduced into the spinneret 2 through the molten resin inlet pipe 1. Many spinning nozzles are equipped below the spinneret 2, and a multiple number of filaments 10 are spun out of the spinning nozzles. The spun filaments 10 are introduced into the quenching chamber 3. The exhaust nozzle 4, which is used to discharge mainly the vapor of low molecular weight polymer, is equipped between the spinneret at the upper part of the quenching chamber 3 and the quench air feed chamber 12. The amount of exhaust vapor from this exhaust nozzle 4 is appropriately adjusted by the control valve 5.

In the quenching chamber 3, the filaments are exposed to the quench air incoming from two opposite directions (the flow directions are shown by arrows 11 in FIG. 1) thereby to quench the filaments. At the exit of the quench air feed chamber 12, the mesh 6 is equipped to accomplish straightening effect for quench air. The quench air feed chamber 12 is divided into at least 2 sections in vertical direction, wherein an air velocity of the quench air in the lowermost stream is set higher than that of the quench air in the uppermost stream. In the case that the quench air feed chamber is vertically divided into 2 sections as shown in FIG. 1, the air velocity ratio of the quench air in the upper stream to that in the lower stream is preferably within the range described above. The temperature of the quench air may be the same or different in the respective streams. In any case, the temperature is preferably set forth in the range described above.

Thus, by dividing the quench air in vertical direction and changing cooling conditions, even if amount of the quench air is increased, a diameter of filament can be reduced without any filament breakage or loss of productivity. And thus manufacturing of stable nonwoven fabric can be accomplished without any quality defect such as shot.

The lower part of the quenching chamber 3 is narrowed down from both sides to form a narrow path (drawing section 7). The velocity of the quench air is accelerated in this narrow path and then the quench air works as drawing air to draw the cooled filaments. The filaments directed out of the drawing section 7 are deposited onto a moving collector surface 8 comprising a mesh or punching plates, and thus web is formed. Under the collector surface 8, a suction box 9 is installed to aspirate the drawing air exhausted out of the drawing section. A web obtained by deposition is then entangled by an apparatus (not illustrated) to form nonwoven fabric. Entangling method is not particularly limited, and the entangling may be performed by any methods such as a needle punching method, a water jet method, an embossing method or an ultrasonic wave welding method.

In the above paragraph, detail has been described about the closed type manufacturing apparatus of spun-bonded nonwoven fabric. In case of an opened type apparatus, except that round shape air guns or slit air guns are installed in drawing section and drawing air is additionally introduced, the same apparatus as the closed type apparatus is adopted.

In the present method for manufacturing nonwoven fabric, because cooling of filaments is performed under optimal conditions, even if quantity of quench air is increased, diameter of filaments can be reduced without filament breakage or decrease in productivity, and as a result stable manufacturing of nonwoven fabric may be accomplished.

EXAMPLES

Measuring methods used in the following Examples and Comparative Examples will be described below.

(1) Filament Breakage

Filament formation at the openings of the nozzle was observed, and a frequency of filament breakage was counted per five minutes. Criteria of evaluation are shown below.

: no filament breakage (0 times/5 minutes)

○: a little filament breakage (1 to 2 times/5 minutes)

X: many filament breakage (3 times or more/5 minutes)

(2) Shot

Number of shots observed in nonwoven fabric of length of 2 m in current direction was counted. The number was evaluated comparing with the shots' number of a sample of comparative example 1 used as control.

Examples 1 to 5, Comparative Examples 1 and 2

A nonwoven fabric was produced using an apparatus shown in FIG. 1. Polypropylene homopolymer having value of 60 g/10 min of melt flow rate measured by load of 2.16 kg, at temperature of 230° C. based on ASTM D1238 was used as a raw material resin. A temperature of molten resin was set at 200° C., a single hole discharge rate was set at 0.57 g/min and a cross section area of a quench air feed chamber outlet was divided into two sections to have ratio (area of an upper stage/total area) of 0.44. Furthermore, nonwoven fabrics (width 100 mm) were produced under a condition of a flow rate, velocity and temperature of quench air shown in Table 1. An evaluation result is shown in Table 1.

TABLE 1

| | | | Example 1 | Example 2 | Example 3 | Example 4 | Example 5 | Comparative Example 1 | Comparative Example 2 |
|---|---|---|---|---|---|---|---|---|---|
| Quench air in upper stream | Velocity | (m/s) | 0.56 | 0.23 | 0.56 | 0.23 | 0.07 | 0.72 | 0 |
| | Flow rate | ($m^3$/min) | 2.67 | 1.12 | 2.67 | 1.12 | 0.34 | 3.45 | 0 |
| | Temperature | (° C.) | 20 | 20 | 20 | 20 | 20 | 20 | — |
| Quench air in lower stream | Velocity | (m/s) | 0.85 | 1.11 | 0.85 | 1.11 | 1.24 | 0,72 | 1.29 |
| | Flow rate | ($m^3$/min) | 5.09 | 6.64 | 5.09 | 6.64 | 7.41 | 4.31 | 7.76 |
| | Temperature | (° C.) | 20 | 20 | 50 | 50 | 50 | 20 | 20 |
| Air velocity ratio (upper stream/lower stream) | | | 0.66 | 0.21 | 0.66 | 0.21 | 0.06 | 1 | 0 |
| Total flow rate of quench air | | ($m^3$/min) | 7.76 | 7.76 | 7.76 | 7.76 | 7.76 | 7.76 | 7.76 |
| Fineness | | (denier) | 2.4 | 2.5 | 2.1 | 2.4 | 2.4 | 2.4 | 2.5 |
| Filament breakage | | | ○ | ○ | ○ | ○ | ◎ | X | X |
| Shot | | | Equal to control | Equal to control | Equal to control | Equal to control | Equal to control | Control | Equal to control |

Examples 6 to 8, Comparative Example 3

The same method was followed to produce nonwoven fabrics as Example 1 besides conditions that were changed to the conditions shown in Table 2. Evaluation results are shown jointly in Table 2.

TABLE 2

| | | | Example 6 | Example 7 | Example 8 | Comparative Example 3 |
|---|---|---|---|---|---|---|
| Quench air | Air velocity | (m/s) | 0.38 | 0.34 | 0.50 | 0.87 |
| in upper | Flow rate | ($m^3$/min) | 1.82 | 0.81 | 2.97 | 4.17 |
| stream | Temperature | (° C.) | 20 | 20 | 20 | 20 |
| Quench air | Air velocity | (m/s) | 2.05 | 1.26 | 2.53 | 0.87 |
| in lower | Flow rate | ($m^3$/min) | 7.39 | 7.58 | 6.08 | 3.13 |
| stream | Temperature | (° C.) | 20 | 20 | 20 | 20 |
| Air velocity ratio (upper stream/lower stream) | | | 0.18 | 0.27 | 0.20 | 1 |
| Total flow rate of quench air ($m^3$/min) | | | 9.22 | 8.39 | 9.05 | 7.30 |
| Cross-section area ratio (upper/total) | | | 0.57 | 0.29 | 0.71 | — |
| Fineness | | (denier) | 1.2 | 1.5 | 1.4 | 2.1 |
| Filament breakage | | | ◎ | ◎ | ◎ | X |
| Shot | | | Equal to control | Equal to control | Equal to control | Control |

Examples 9 to 10, Comparative Example 4

Nonwoven fabric was produced in a manner similar to Example 1 except that the quench air feed chamber exit was divided into 3 so that the area of the exit for the quench air feed chamber was 0.29 in the uppermost area/the total area and 0.29 in the second area/the total area and the conditions were changed to those shown in Table 3. The results of evaluation are included in Table 3.

TABLE 3

| | | | Example 9 | Example 10 | Comparative Example 4 |
|---|---|---|---|---|---|
| Quench air in | Air velocity | (m/s) | 0.31 | 0.52 | 0.79 |
| uppermost. | Flow rate | ($m^3$/min) | 0.75 | 1.24 | 1.89 |
| stream | Temperature | (° C.) | 20 | 20 | 20 |
| Quench air in | Air velocity | (m/s) | 0.45 | 0.86 | 0.79 |
| 2nd stream | Flow rate | ($m^3$/min) | 1.08 | 2.07 | 1.89 |
| | Temperature | (° C.) | 20 | 20 | 20 |
| Quench air in | Air velocity | (m/s) | 2,05 | 1.41 | 0.79 |
| lowermost. | Flow rate | ($m^3$/min) | 7.39 | 5.08 | 2.84 |
| stream | Temperature | (° C.) | 20 | 20 | 20 |
| Air velocity ratio (uppermost stream/lowermost stream) | | | 0.15 | 0.37 | 1.00 |
| Air velocity ratio (2nd stream/lowermost stream) | | | 0.22 | 0.61 | 1.00 |
| Total flow rate of quench air | | ($m^3$/min) | 9.22 | 8.40 | 6.62 |
| Cross-section area ratio (uppermost/total) | | | 0.29 | 0.29 | — |
| Cross-section area ratio | | (2nd/total) | 0.29 | 0.29 | — |
| Fineness | | (denier) | 1.2 | 1.5 | 2.3 |
| Filament breakage | | | ◎ | ◎ | X |
| Shot | | | Equal to control | Equal to control | Control |

INDUSTRIAL APPLICABILITY

According to the method and apparatus for manufacturing nonwoven fabric of the present invention, since quench air fed to the quenching chamber is divided into at least 2 sections in vertical direction and cooling is adjusted and performed optimally in each section, diameter of filaments can be reduced without filament breakage or decrease in productivity, and as a result stable manufacturing for nonwoven fabric can be accomplished.

What is claimed is:

1. A method for manufacturing spun-bonded nonwoven fabrics, which comprises:

quenching a multiple number of continuous filaments melt-spun through spinning nozzles with quench air fed to quenching chamber, drawing the filaments with drawing air, and depositing the filaments on a moving collector surface, wherein the quench air fed to the quenching chamber is divided into at least 2 streams in a vertical direction, and an air velocity ratio ($V_1/V_n$) of the quench air velocity in the uppermost stream ($V_1$) to that in the lowermost stream ($V_n$) is in range of $0.01 \leqq V_1/V_n < 0.7$, and a velocity $V_m$ of the quench air in a $m^{th}$ stream (wherein $n \geqq m \geqq 2$) from a top satisfies $V_m \geqq V_{m-1}$, wherein the quench air works as the drawing air at a drawing section formed as a narrowed path, and wherein the temperature in the lowermost stream is higher by at least 10° C. than that in the uppermost stream.

2. The method for manufacturing spun-bonded nonwoven fabrics according to claim 1, wherein the quench air fed to the quenching chamber is divided into 2 to 20 streams in the vertical direction.

3. The method for manufacturing spun-bonded nonwoven fabrics according to claim 2, wherein the quench air fed to the quenching chamber is divided into 2 streams in the vertical direction.

4. The method for manufacturing spun-bonded nonwoven fabrics according to claim 1, wherein the temperature in the lowermost stream is higher than that in the uppermost stream by 10° C. to 70° C.

5. The method for manufacturing spun-bonded nonwoven fabrics according to claim 4, wherein the temperature of the quench air in the uppermost stream is in the range of 10° C. to 40° C., and the temperature of the quench air in the lowermost stream is in the range of 30° C. to 70° C.

6. The method for manufacturing spun-bonded nonwoven fabrics according to claim 2, wherein the temperature in the lowermost stream is higher than that in the uppermost stream by 10° C. to 70° C., respectively.

7. The method for manufacturing spun-bonded nonwoven fabrics according to claim 6, wherein the temperature of the quench air in the uppermost stream is in the range of 10° C. to 40° C., and the temperature of the quench air in the lowermost stream in the range of 30° C. to 70° C.

8. The method for manufacturing spun-bonded nonwoven fabrics according to claim 3, wherein the temperature in the lowermost stream is higher than that in the uppermost stream by 10° C. to 70° C., respectively.

9. The method for manufacturing spun-bonded nonwoven fabrics according to claim 8, wherein the temperature of the quench air in the uppermost stream is in the range of 10° C. to 40° C., and the temperature of the quench air in the lowermost stream is in the range of 30° C. to 70° C.

10. An apparatus for manufacturing spun-bonded nonwoven fabrics comprising:

spinning nozzles for melt-spinning a multiple number of continuous filaments, a quenching chamber for quenching the spun filaments with quench air, a drawing section for drawing the quenched filaments with drawing air, and a moving collector surface for depositing thereon the filaments drawn from the drawing section, wherein the quench air fed to the quenching chamber is divided into at least 2 streams in a vertical direction, the velocities of the quench air are independently controllable in the respective streams, and a ratio of a blowing area of the quench air fed to the quenching chamber ranges from 0.1 to 0.9 in a ratio of the blowing area in the uppermost stream to a total blowing area, wherein an air velocity ratio ($V_1/V_n$) of the quench air velocity in the uppermost stream ($V_1$) to that in the lowermost stream ($V_n$) is in a range of $0.01 \leqq V_1/V_n < 0.7$, a velocity $V_m$ of the quench air in a $m^{th}$ stream (wherein $n \geqq m \geqq 2$) from a top satisfies $V_m \leqq V_{m-1}$, wherein the quench air is introduced to the drawing section formed as a narrow path for working as the drawing air, and wherein the temperature in the lowermost stream is higher by at least 10° C. than that in the uppermost stream.

11. The apparatus for manufacturing spun-bonded nonwoven fabrics according to claim 10, wherein the quench air fed to the quenching chamber is divided into 2 to 20 streams in the vertical direction.

12. The method for manufacturing spun-bonded nonwoven fabrics according to claim 1, wherein the ratio ($V_1/V_n$) has range of $0.01 \leqq V_1/V_n < 0.5$.

13. The method for manufacturing spun-bonded nonwoven fabrics according to claim 1, wherein the ratio ($V_1/V_n$) has a range of $0.05 \leqq V_1/V_n < 0.4$.

14. The apparatus for manufacturing spun-bonded nonwoven fabrics according to claim 10, wherein the ratio ($V_1/V_n$) has a range of $0.01 \leqq V_1/V_n 0.5$.

15. The apparatus for manufacturing spun-bonded nonwoven fabrics according to claim 10, wherein the ratio ($V_1/V_n$) has a range of $0.05 \leqq V_1/V_n < 0.4$.

* * * * *